US005667533A

United States Patent [19]

Hauser et al.

[11] Patent Number: 5,667,533

[45] Date of Patent: Sep. 16, 1997

[54] HEATHER DYED FABRIC AND METHOD OF PRODUCING SAME

[75] Inventors: Peter J. Hauser, Gastonia, N.C.; Stewart G. Helfrich, Hamburg, Pa.

[73] Assignee: The Virkler Company, Charlotte, N.C.

[21] Appl. No.: 597,921

[22] Filed: Feb. 7, 1996

[51] Int. Cl.[6] ..... D06P 1/66; D06P 5/22

[52] U.S. Cl. ..... 8/606; 8/478; 8/918; 8/930

[58] Field of Search ..... 8/478, 606, 918, 8/483–4, 930

[56] References Cited

U.S. PATENT DOCUMENTS

| | | | |
|---|---|---|---|
| 2,430,153 | 11/1947 | Womble et al. | 8/606 |
| 3,778,225 | 12/1973 | Cuvelier et al. | 8/606 |
| 3,854,872 | 12/1974 | Balland . | |
| 4,072,464 | 2/1978 | Balland . | |
| 4,380,453 | 4/1983 | Claiborne | 8/606 |
| 4,615,709 | 10/1986 | Nakao . | |
| 4,629,470 | 12/1986 | Harper, Jr. | 8/606 |
| 5,006,125 | 4/1991 | Patton et al. . | |
| 5,133,779 | 7/1992 | Töpfl et al. | 8/606 |
| 5,147,411 | 9/1992 | Töpfl | 8/606 |
| 5,330,541 | 7/1994 | Hall et al. . | |
| 5,484,457 | 1/1996 | Schulze et al. | 8/543 |

FOREIGN PATENT DOCUMENTS

| | | |
|---|---|---|
| 1236882 | 6/1971 | United Kingdom . |
| 1286535 | 8/1972 | United Kingdom . |

OTHER PUBLICATIONS

Rupin, M., AATCC Bulletin, "Dyeing with Direct and Fiber Reactive Dyes", vol. 8, No. 9, Sep. 1976, pp. 54–58.

Dow Paper, Quat 188 Cationic Reagent, For Modifying Polymers to Produce Quaternary Ammonium Compound, pp. 1–19; Oct. 1992.

Fairchild's Dictionary of Textiles, Edited by Dr. Isabel B. Wingate, Fourth Printing 1975, p. 245 no month available.

*Primary Examiner*—Margaret Einsmann

*Attorney, Agent, or Firm*—Bell, Seltzer, Park & Gibson, P.A.

[57] ABSTRACT

Textile fabrics and garments having a random, irregular heather-like appearance are produced by impregnating a textile fabric with an aqueous pretreaement composition comprising a fiber reactive cationic compound, aging the impregnated fabric in a moistened state for about 4 to 24 hours to allow the fiber reactive cationic compound to react with the fibers of the fabric, rinsing the fabric to remove unreacted cationic compound, immersing the fabric in an aqueous bath at a pH of less than 7 and gradually introducing dyestuffs to the bath over a period of at least 15 minutes, and fully exhausting the dyestuffs onto the fabric. The process is applicable for dyeing either piece goods or garments. Where the fabric is in the form of garments, it is preferred that the aging be carried out by storing the garments in an insulated sealed container.

18 Claims, 1 Drawing Sheet

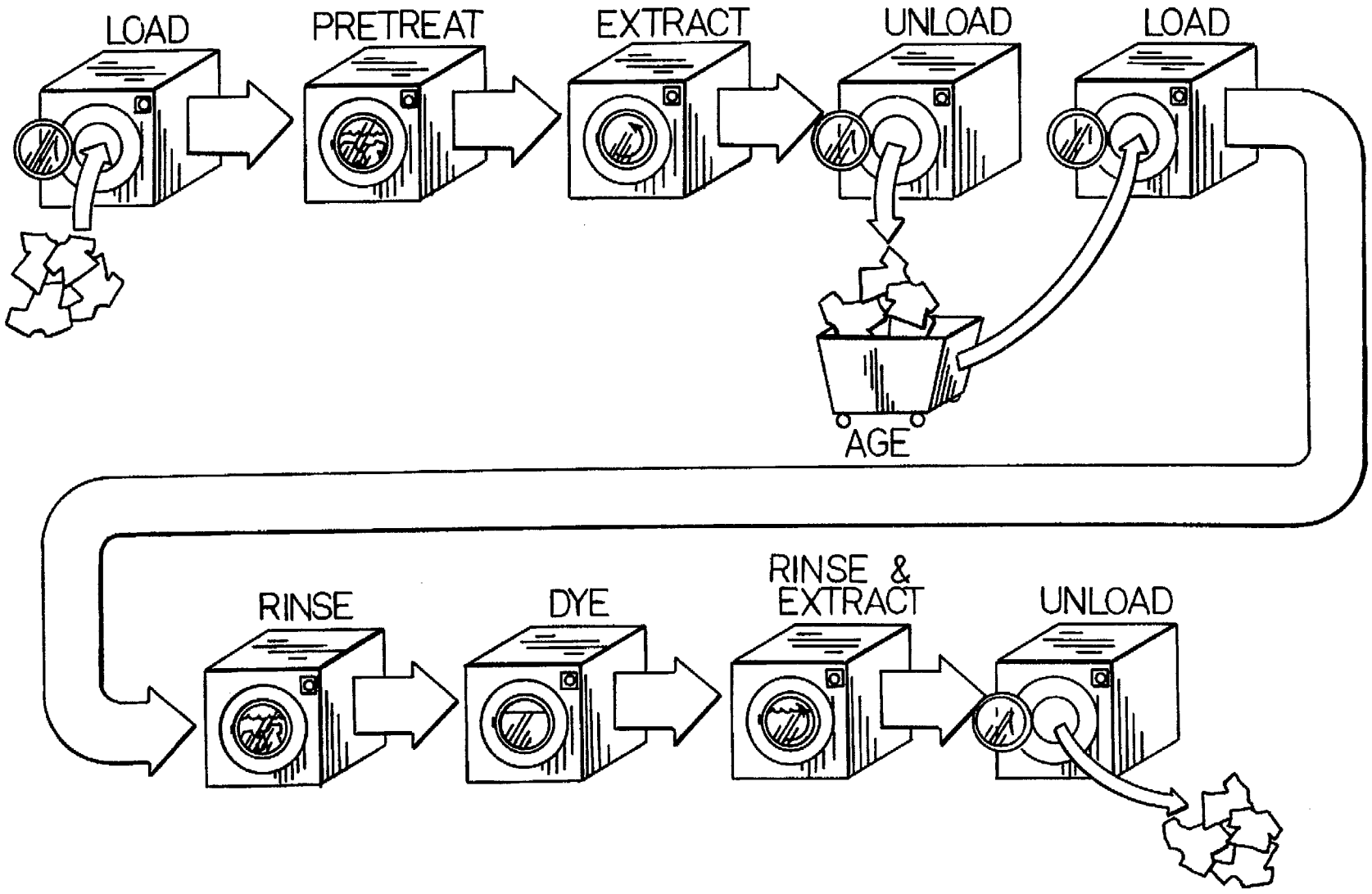
LOAD
PRETREAT
EXTRACT
UNLOAD
LOAD
AGE
RINSE
DYE
RINSE & EXTRACT
UNLOAD

HEATHER DYED FABRIC AND METHOD OF PRODUCING SAME

FIELD AND BACKGROUND OF THE INVENTION

This invention relates to textile fabrics having a random, irregular heather-like appearance and to a method of producing such a heather-like appearance by dyeing.

In most textile dyeing processes, the objective is to obtain a uniform level dyeing throughout the fabric. Fabrics with a nonuniform dyed appearance are traditionally regarded as inferior or defective. Numerous techniques, compositions and additives have been developed with the aim of achieving consistent level dyeing of textiles.

However, for certain styling effects, a controlled nonlevelness of dyeing may be desirable. For example, a popular styling effect in apparel fabrics is a nonuniform mottled or "heather" look. Traditionally, this heather look has been achieved by cross dyeing, for example, by blending two or more different kinds of fibers which receive dye differently. For example, natural or cellulosic fibers may be blended with synthetic fibers and cross dyed with different classes of dyestuffs to achieve the heather look.

Achieving the mottled or heather look in a 100 percent natural fiber fabric presents additional challenges. Typically, this is achieved by blending some predyed fiber with undyed fiber, spinning the blended fibers into yarns and thereafter forming textile fabrics therefrom. Since it requires special handling and processing going all the way back to the fiber blending stage, it imposes significant limitations on the ability, cost and speed at which changes can be made in color styling, etc. Furthermore, this approach does not lend itself for certain manufacturing techniques, such as garment dyeing, which are in popular use in producing apparel.

Accordingly, the need exists for a practical and effective method for producing heather-like styling effects in textile fabrics. In particular, the need exists for a practical and effective way to achieve heather dyed effects by garment dyeing.

SUMMARY OF THE INVENTION

Accordingly, the present invention provides a process for dyeing textiles to achieve a heather-like appearance. The present invention further provides a unique dyed textile fabric having a heather-like appearance.

In general, the process of the present invention involves impregnating a textile fabric with an aqueous pretreatment composition comprising a fiber reactive cationic compound. The impregnating may be accomplished by spraying, padding, immersing or any other suitable method. The impregnated fabric is aged in a moistened state for about 4 to 24 hours to allow the fiber reactive cationic compound to react with the fibers of the fabric. The fabric is then rinsed to remove unreacted cationic compound. Subsequently, the fabric is immersed in an aqueous bath at a pH of less than 7 and dyestuffs are gradually introduced to the bath over a period of at least 15 minutes. The dyestuffs are fully exhausted onto the fabric and result in the fabric having a heather-like dyed appearance. Preferably, the cationic compound is a quaternary ammonium compound and the fabric is impregnated by immersion in an alkaline aqueous bath containing preferably 10 to 100 g/l of the quaternary ammonium compound.

In its broadest aspect, the process is applicable for dyeing either piece goods or garments. Where the fabric is in the form of garments, it is preferred that the aging be carried out by storing the garments in an insulated sealed container. This keeps the garments thoroughly moistened during the period of time required for the cationic compound to react with the textile fibers and avoids nonuniformities or discolorations resulting from moisture condensing on portions of the fabric. Ideally, the garments are wrapped in another fabric which is saturated with the pretreatment composition and the thus wrapped garments are stored and aged in the sealed container.

The dyed textile fabric of the present invention has an appearance resembling the heather-like appearance obtained by prior conventional methods. However, the fabric is unique and distinctly different chemically and physically from heather dyed fabrics produced by prior conventional methods. The dyed textile fabric of the present invention comprises a textile fabric formed of yarns containing cellulosic fibers and a fiber reactive cationic compound uniformly applied throughout the fabric. The cationic compound is chemically bound to and caps some of the reactive hydroxyl sites of the cellulosic fibers and the cationic compound provides reactive dye sites distributed uniformly throughout the fabric. Typically, the cationic compound is bound to about 0.1 to 5 percent, preferably 0.5 to 2 percent of the hydroxyl sites of the cellulosic fibers. The fabric further includes dyestuffs distributed nonuniformly and randomly throughout the fabric. The dyestuffs are reacted with and bound to a fraction of the reactive dye sites to impart a random heather-like appearance to the dyed fabric. Preferably, the reactive cationic compound comprises a quaternary ammonium compound and a particularly suitable such compound is a propylene epoxy ammonium salt.

In addition to providing a dyed fabric of unique appearance, the present invention presents significant processing advantages as compared to presently known dyeing systems. No salt is required to exhaust dyes. The expense, handling difficulties and disposal problems associated with salt are thus eliminated. The dyes exhaust completely onto the treated fabrics and the deeper shades thus obtained allow significant reductions in dyestuffs usage, as well as providing improved quality effluents. The process has shorter dye cycles, which significantly reduces energy requirements and increases throughput. The process can reduce water consumption. The process can be used successfully both with garments and with piece goods.

Various prior publications have described processes for modifying cellulosic fiber using cationic adducts to render the fiber more receptive to anionic, direct or fiber reactive dyes. However, these modified cellulosic fibers have found only limited commercial acceptance due to the inability to uniformly apply the cationic pretreatment, the limited ability to control the increased dyestuff rate-of-strike, poor marginal lightfastness, and the difficulty in repairing off-shade or unlevel fabrics. The present invention provides an extremely uniform fiber pretreatment, controls completely the dyestuff rate-of-strike, does not adversely affect the lightfastness of the dyed fibers, and allows off-shade or unlevel goods to be easily repaired.

BRIEF DESCRIPTION OF THE DRAWING

Some of the features and advantages of the invention having been described, others will become apparent from the detailed description and examples which follow, and from the accompanying drawing which is a schematic flow chart illustrating a process in accordance with the present invention.

DESCRIPTION OF ILLUSTRATIVE EMBODIMENT

The present invention will be described more fully hereinafter in connection with an illustrative embodiment of the invention which is given so that the present disclosure will be thorough and complete and will fully convey the scope of the invention to those skilled in the art. However, it is to be understood that this invention may be embodied in many different forms and should not be construed as being limited to the specific embodiment described and illustrated herein. Although specific terms are used in the following description, these terms are merely for purposes of illustration and are not intended to define or limit the scope of the invention.

The drawing schematically illustrates a treatment and dyeing process in accordance with the invention as applied to garments. However, the principles of the present invention and advantages therefrom can also be achieved in other processes, such as in a pad-batch process for handling textile fabric in the form of piece goods. As shown, the process is carried out in a conventional commercial washer/extractor machine W. The machine illustrated is a front loading machine having a rotatable drum. Machines of this type are commercially available from several sources, such as Milnor, Washex, and Braun for example.

The garments G are initially loaded in the machine as indicated at 10. Preferably, the garments are initially scoured by introducing a scouring bath into the drum and tumbling the garments in the bath for a short period of time. Conventional caustic scouring agents can be employed. This scouring step removes processing oils or other fabric additives which could interfere with the dyeing operation. Such scouring steps are well known and conventional.

The scouring bath is drained from the drum, the fabric is extracted, and then an aqueous pretreatment bath is added, as indicated at 12, preferably at a bath to goods weight ratio of about 10:1 to 5:1. The pretreatment bath preferably contains from about 5 to 100 grams per liter of a fiber reactive cationic compound. A preferred fiber reactive cationic compound is a quaternary ammonium derivative, and particularly suitable for this purpose is a quaternary ammonium epoxide compound, such as a propyl epoxy ammonium salt having the general formula:

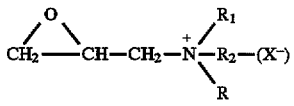

Wherein R, $R_1$ and $R_2$ are each lower alkyl radicals and $X^-$ is an anion. Fiber reactive cationic quaternary ammonium compounds of this general class have been used as additives for treating textile fabrics either prior to or during dyeing and are disclosed for example in the following patents: GB 1,286,535; GB 1,236,882, U.S. Pat. Nos. 3,685,953; 4,072,464; 4,615,709; 5,006,125; and in Rupin, "Dyeing With Direct And Fiber Reactive Dyes", *AATCC Bulletin*, Vol. 9, No. 9, September 1976, pp. 54–58.

The pretreatment bath is prepared by mixing the cationic compound with water at a concentration of preferably 10 to 100 grams per liter. In addition, the bath is rendered alkaline, by addition of a suitable compound such as caustic soda in an amount sufficient to activate the hydroxyl groups of the cellulose so that the reaction with the fiber reactive quaternary ammonium compound will take place within a desired time period of up to about 8 hours at existing ambient temperature conditions. Preferably, the amount of caustic soda added is such as to make the pH of the bath about 13 or higher. The bath, when prepared, has a half-life of about 3 to 4 hours at the preferred concentration and alkalinity levels. Consequently, it is preferred that the caustic soda be added to the bath a short time prior to when the treatment is to be carried out.

Preferably, the bath also contains a rheology modifying agent which will assist in preventing movement or seepage of the treatment bath during the aging step. Suitable rheology modifying agents include high molecular weight polymers such as high molecular weight polyacrylamide polymers of molecular weight six million or higher. Other conventional additives, such as wetting agents, may be optionally provided in the bath.

After the garments have been loaded in the washer extractor and optionally scoured, the premixed pretreatment bath is introduced into the machine preferably at about a 5:1 liquor to goods ratio by weight. The garments are tumbled in the bath for about 10 to 15 minutes to achieve thorough saturation and impregnation of the garments. The treatment bath is then drained and may optionally be saved in a storage tank.

Then, as shown at 14, the goods are extracted to remove excess pretreatment composition, leaving the goods in a moist state still thoroughly impregnated with the pretreatment solution. Preferably, the extraction is carried out to reduce the moisture content to about 100 percent wet pick up.

After extracting, the garments are preferably slow tumbled in the extractor for about 10 minutes to assure uniform distribution of the pretreatment composition.

At this point, the garments are unloaded from the washer extractor as indicated at 16. The garments are placed in a sealed container to prevent evaporation of the pretreatment composition and are aged at room temperature for about 4 to 24 hours. As shown in the drawing, the garments G can be stored in a wheeled plastic storage cart. To keep the garments from drying, the goods are covered with plastic or a cover is placed on the storage cart C.

Preferably, to avoid possible contamination or irregular dyeing due to moisture condensing on areas of the garment and diluting the pretreatment composition, it is desirable that the walls of the container be insulated. It may also be desirable to wrap the garments in a sheet or fabric bag which has been thoroughly wetted with the pretreatment solution and then to store the wrapped garments in the storage cart. This prevents the garments from coming into direct contact with the walls of the storage cart where condensation could occur.

After aging for at least four hours, the garments are ready for further processing. As shown at 18, they are removed from the storage cart C and placed in a rotary dyeing machine D. The machine illustrated is a front loading rotary dyeing machine, although those skilled in the art will appreciate that other types of dyeing machines can be suitably employed. The machine is filled to the appropriate operating level with water and the garments are thoroughly rinsed, as indicated in the drawing at 20. Preferably, two rinses are carried out at 110° F. for five minutes each rinse.

At this point, an aqueous dye bath is introduced into the machine, as indicated at 22. Preferably, the initial bath temperature is about 80° F. and the liquor to goods ratio is at least 10:1. The aqueous bath initially contains an acid, such as acetic acid, and a buffering agent, both in amounts sufficient to bring the pH to below seven. Preferably, the initial pH is set between 5.5 and 6. Suitable acids which can be utilized include acetic acid and citric acid. Buffered or partially neutralized citric and acetic acid may also be suitably used. After the goods have been thoroughly impregnated with the acid bath, dyestuffs are introduced into the bath on a very slow, gradual basis. Preferably, the dyestuffs are introduced over a period of at least 15 minutes, and desirably over a period of about 20 to 30 minutes. Because of the very gradual introduction of dyestuffs, the dye bath remains clear at all times and the dye is fully exhausted onto the fibers.

The amount of dyestuffs used is carefully controlled in relation to the amount of the fiber reactive cationic compound which was fixed on the fibers so that there is a relatively high ratio of cationic agent to dyestuff. Preferably, this ratio should be maintained within the range of about 3:1 to 5:1. As a result of this ratio, there is a tremendous affinity for a very small amount of dye, and as the dye is gradually introduced into the bath, it is randomly and nonuniformly distributed throughout the fabric and reacts with and becomes bound to only a fraction of the available cationic dye sites provided by the fiber reactive cationic compound. This produces a controlled non-levelness of dyeing resulting in a random heather-like dyed appearance in the fabric.

Basically, any kind of anionic dye can be suitably employed in this process. Preferably, the dyestuffs include at least one dye selected from the group consisting of direct dyes, metallic dyes, acid dyes, sulfur dyes, vat dyes, pigment dyes, reactive dyes and natural dyes. The specific dyestuffs used may be selected by those skilled in the art depending upon the type of fabric used, the particular color desired and the patterning effect desired and whether the textile material is in the form of garments or in another form. For example, with garments containing cellulosic fibers, such as cotton, direct dyes, fiber reactive dyes, acid dyes, vat dyes, sulfur dyes and/or pigment dyes may be used. Examples of suitable direct dyes include Direct Red 24, Direct Red 79, Direct Red 80, Direct Blue 189, Direct Blue 191. Most shades with a properly balanced formula will be fully exhausted onto the garments.

For optimum fastness properties, the fully exhausted bath is then rapidly heated to about 180° to 200° F. and held for five minutes. Afterwards, the bath is drained and the fabric is rinsed and extracted as indicated at 24 in the drawing. Finally, the dyed garments are removed from the machine as indicated at 26 and are dried and further processed in a conventional manner removed from the dye machine.

The fabric which results from this process is characterized by having the cationic compound reacted with and bound to about 0.1 to 5 percent, preferably about 0.5 to 2 percent, of the reactive hydroxyl sites of the cellulosic fibers and thus providing reactive dye sites distributed uniformly throughout the fabric. However, the dyestuffs are distributed nonuniformly and randomly throughout the fabric with the dyestuffs being reacted with and bound to only a fraction of the reactive dye sites thus imparting the desired random heather-like appearance to the dyed fabric.

After the dye has been fully exhausted onto the dye bath and before the bath is drained, optional additives may be introduced into the bath. Specifically, additives such as anionic softeners, soil release agents, anti-stain agents, anti-static agents or the like can be added to the bath, either prior to heating or afterward.

As noted earlier, it is important to control the relationship between the amount of cationic agent and the amount of dye employed. Preferably, these materials are used according to the following proportions:

| Percent of Dyes | Cationic Compound |
|---|---|
| .1–.49% | 20–30 g/l |
| .5–.99% | 30–40 g/l |
| 1–1.99% | 40–60 g/l |

Desirably, the following relationship is used:

Cat. Comp. (*g/l*)=(% Dye×20)+at least 20

When the cationic agent is reacted with the fabrics under the conditions described, it will produce a fixed nitrogen content of 0.05 to 0.2 percent by weight on the fibers of the fabric.

The following example illustrates how garments are heather dyed in accordance with this invention.

EXAMPLE

A pretreatment bath is made by slowly adding to water at room temperature 60 g/l of trimethylammonium epoxy propyl chloride and 45 grams per liter of caustic soda (50% NaOH) to produce a resultant bath pH of approximately 13, and 20 g/l of a high molecular weight polyacrylamide solution. The latter compound serves as an anti-migrant agent modifying the rheology of the bath to retard movement and seepage during storage. The bath is preferably made up at room temperature, with the caustic soda being added a short while before the bath is needed.

Two hundred 100 percent cotton T-shirts totaling approximately 100 pounds are placed in a front loading rotary commercial washer extractor machine. The door is closed, and water at 80°–90° F. is added at about a 10:1 water to goods ratio by weight. About 5 g/l of a commercial alkaline scouring agent (e.g., VIRCOSCOUR available from Virkler Company of Charlotte, N.C.) is introduced into the drum. The goods are agitated and tumbled for 10 minutes to thoroughly scour the garments.

The scouring bath is drained from the machine, the fabric is extracted, and the premixed pretreatment bath is added to the machine at a 5:1 liquor to goods ratio. The garments are tumbled for 15 minutes. The bath is then drained. The garments are extracted down to 100 percent wet pick up and are then slowly tumbled for 10 minutes.

A thermally insulated wheeled plastic cart is placed beside the washer extractor and a cotton bedsheet which has been thoroughly moistened with the pretreatment bath is positioned in the cart to line the interior of the cart. The thus treated garments are removed from the extractor and transferred to the cart with care being taken to see that the garments are all surrounded by the bed sheet and do not come into direct contact with the walls of the cart. The sheet is then placed over the garments and a tightly fitting lid is positioned on the cart. The goods are stored in this condition for eight hours.

The goods are then removed from the cart and placed in a rotary dyeing machine and rinsed with two rinse baths at 110° F. for five minutes in each rinse. Then water at a 10:1 water to goods ratio was added to the machine together with 1 g/l of buffered acetic acid. The pH of the bath was measured and found to be about 5.5.

A dyestuffs mixture was prepared by mixing, for 100 pounds of fabric, 0.44 lb (0.44%) Direct Blue 90; 0.22 pounds (0.22%) Direct Yellow 2RLSW (Crompton & Knowles) and 0.09 pounds (0.09%) Direct Red 81 and about 20 gallons of water. This mixture was slowly added to the dyeing machine over a period of 30 minutes at a temperature of 80° F. while continuously mixing. As the dyestuffs mixture was added to the machine, the bath itself remained clear. After all of the dyestuff was added, the garments were agitated for an additional 10 minutes at 80° F. Then, the temperature of the bath was heated rapidly (6° per minute) to 180° F. and held at this temperature for five minutes.

The bath was drained and the garments were rinsed twice in room temperature water, extracted and then removed from the dyeing machine. The garments exhibit an aesthetically pleasing heather-like appearance.

That which is claimed is:

1. A process for dyeing textiles to achieve a heather-like appearance comprising:

impregnating a textile fabric with an aqueous pretreatment composition comprising a fiber reactive cationic compound;

aging the impregnated fabric in a moistened state for about 4 to 24 hours to allow the fiber reactive cationic compound to react with the fibers of the fabric;

rinsing the fabric to remove unreacted cationic compound;

immersing the fabric in an aqueous bath at a pH of less than 7 and gradually introducing dyestuffs to the bath over a period of at least 15 minutes; and fully exhausting the dyestuffs onto the fabric.

2. A process according to claim 1 wherein said reactive cationic compound comprises a quaternary ammonium derivative, and said impregnating step comprises immersing the fabric in an aqueous bath containing 5 to 100 g/l of said quaternary ammonium derivative.

3. A process according to claim 2, wherein said aqueous pretreatment composition has a pH of about 13 or greater.

4. A process according to claim 2, wherein said quaternary ammonium derivative comprises a quaternary ammonium epoxide.

5. A process according to claim 2, wherein said quaternary ammonium derivative comprises a propyl epoxy ammonium salt having the general formula:

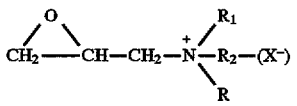

Wherein R, $R_1$ and $R_2$ are each lower alkyl radicals and $X^-$ is an anion.

6. A process according to claim 2, wherein the concentration of dyestuffs is from 0.1 to 2 percent of the weight of the goods, and the concentration of said cationic compound in said pretreatment composition has the following relationship to the amount of dyestuffs:

Cat. Comp. (g/l)=(% Dye×20)+at least 20.

7. A process according to claim 2, wherein the concentration of dyestuffs is from 0.1 to 2 percent of the weight of the goods, and the concentration of said cationic compound in said pretreatment composition is from 20 to 60 g/l.

8. A process according to claim 1, wherein said textile fabric comprises cellulosic fibers and wherein said dyestuffs comprise at least one dye selected from the group consisting of direct dyes, metallic dyes, acid dyes, sulfur dyes, vat dyes, pigment dyes, reactive dyes, and natural dyes.

9. A process according to claim 1, wherein said step of aging the fabric comprises storing the fabric at room temperature in a closed insulated container.

10. A process according to claim 9, wherein said fabric is in the form of garments, and said step of aging the fabric further comprises wrapping the garments in fabric saturated with said pretreatment composition and storing the thus wrapped garments in said container.

11. A process for dyeing textile garments to achieve a heather-like appearance comprising:

immersing textile garments in an aqueous bath containing 10 to 100 g/l of a quaternary ammonium compound and caustic soda in an amount sufficient to produce a pH of at least 13;

extracting the garments to a wet pickup of about 100 percent or less;

storing the extracted garments at room temperature in a closed container for about 4 to 24 hours to allow the quaternary ammonium compound to react with the fibers of the garments;

rinsing the garments to remove unreacted quaternary ammonium compound;

immersing the garments in an aqueous bath at a pH of less than 7 and while the garments are in said bath gradually introducing dyestuffs to the bath over a period of at least 15 minutes; and fully exhausting the dyestuffs onto the garments.

12. A process for dyeing textile garments, comprising loading garments containing cellulosic fibers into the drum of a rotary washer/extractor;

introducing into the washer/extractor an aqueous caustic scouring bath and tumbling and thoroughly wetting the garments with the scouring bath;

removing the scouring bath and introducing an alkaline aqueous pretreatment bath comprising a fiber reactive cationic compound at a concentration of 10 to 100 g/l and at a liquor to goods ratio of 5:1 or greater;

tumbling and thoroughly wetting the garments with the pretreatment bath;

removing the pretreatment bath from the drum;

extracting the garments to a wet pickup of about 100 percent or less;

removing the garments from the drum;

wrapping the garments in wet fabric and placing the wrapped garments in a closed container;

storing the garments in the closed container at room temperature for at least 4 hours;

removing the garments from the container and placing them in a rotary dye machine;

introducing a rinse bath into the dye machine and thoroughly rinsing the garments;

introducing into the dye machine an aqueous bath at a pH of 7 or lower, a temperature of about 70 to 100° F. and at a liquor to goods ratio of about 10:1 or higher;

gradually adding dyestuffs to the bath over a period of about 10 to 30 minutes while agitating the garments in the dye machine;

gradually heating the bath to a temperature of about 180° F. to 200° F.;

cooling the garments and removing them from the dye machine.

13. A process for dyeing textiles to achieve a heather-like appearance comprising:

impregnating a textile fabric with an aqueous pretreatment composition comprising a fiber reactive cationic compound;

aging the impregnated fabric in a moistened state for about 4 to 24 hours to allow the fiber reactive cationic compound to react with the fibers of the fabric;

rinsing the fabric to remove unreacted cationic compound;

immersing the fabric in an acidic aqueous bath;

gradually adding dyestuffs to the acidic aqueous bath at a dyestuffs concentration of from 0.1 to 2 percent of the weight of the goods, and correlated with the concentration of said cationic compound in said pretreatment composition such that the following relationship is achieved:

Cat. Comp. (g/l)=(% Dye×20)+at least 20;

and exhausting the dyestuffs onto the fabric.

14. A process according to claim 13, wherein the concentration of dyestuffs is from 0.1 to 2 percent of the weight of the goods, and the concentration of said cationic compound in said pretreatment composition is from 20 to 60 g/l.

15. A process for dyeing textile garments to achieve a heather-like appearance comprising:

immersing textile garments in an aqueous bath containing 10 to 100 g/l of a quaternary ammonium compound and caustic soda in an amount sufficient to produce a pH of at least 13;

extracting the garments to a wet pickup of about 100 percent or less;

storing the extracted garments at room temperature in a closed container for about 4 to 24 hours to allow the quaternary ammonium compound to react with the fibers of the garments;

rinsing the garments to remove unreacted quaternary ammonium compound;

immersing the garments in an aqueous acidic bath and while the garments are in said bath gradually introducing dyestuffs to the bath at a dyestuffs concentration of from 0.1 to 2 percent of the weight of the goods, and correlated with the concentration of said quaternary ammonium compound in said pretreatment composition such that the following relationship is achieved:

Quat Comp. (g/l)=(% Dye×20)+at least 20;

and exhausting the dyestuffs onto the garments.

16. A process for dyeing textile garments, comprising loading garments containing cellulosic fibers into the drum of a rotary washer/extractor;

introducing into the washer/extractor an aqueous caustic scouring bath and tumbling and thoroughly wetting the garments with the scouring bath;

removing the scouring bath and introducing an alkaline aqueous pretreatment bath comprising a fiber reactive cationic compound at a concentration of 10 to 100 g/l and at a liquid to goods ratio of 5:1 or greater;

tumbling and thoroughly wetting the garments with the pretreatment bath;

removing the pretreatment bath from the drum;

extracting the garments to a wet pickup of about 100 percent or less;

removing the garments from the drum;

wrapping the garments in wet fabric and placing the wrapped garments in a closed container;

storing the garments in the closed container at room temperature for at least 4 hours;

removing the garments from the container and placing them in a rotary dye machine;

introducing a rinse bath into the dye machine and thoroughly rinsing the garments;

introducing into the dye machine an aqueous acidic bath at a temperature of about 70 to 100° F. and at a liquid to goods ratio of about 10:1 or higher;

gradually adding dyestuffs to the bath over a period of least about 10 minutes at a dyestuffs concentration of from 0.1 to 2 percent of the weight of the goods, and correlated with the concentration of said cationic compound in said pretreatment composition such that the following relationship is achieved:

Cat. Comp. (g/l)=(% Dye×20)+at least 20, and while agitating the garments in the dye machine;

gradually heating the bath to a temperature of about 180° F. to 200° F.; and cooling the garments and removing them from the dye machine.

17. A process for dyeing textiles to achieve a heather-like appearance comprising:

impregnating a textile fabric containing cellulosic fibers with an aqueous pretreatment composition containing 10 to 100 g/l of a quaternary ammonium compound and caustic soda in an amount sufficient to produce a pH of at least 13;

aging the impregnated fabric in a moistened state for about 4 to 24 hours to allow the pretreatment composition to react with the fibers of the fabric;

rinsing the fabric to remove unreacted quaternary ammonium compound;

immersing the fabric in an acidic aqueous bath at a pH of 5.5 to 6;

gradually adding dyestuffs to the acidic aqueous bath at a dyestuffs concentration of from 0.1 to 2 percent of the weight of the goods, and correlated with the concentration of said quaternary ammonium compound in said pretreatment composition such that the following relationship is achieved:

Cat. Comp. (g/l)=(% Dye×20)+at least 20;

and exhausting the dyestuffs onto the fabric.

18. A process according to claim 17, wherein said quaternary ammonium compound comprises a propyl epoxy ammonium salt having the general formula:

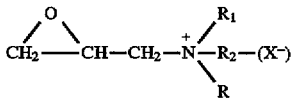

Wherein R, $R_1$ and $R_2$ are each lower alkyl radicals and $X^-$ is an anion.

* * * * *